United States Patent [19]

Nitchman et al.

[11] 4,440,319

[45] Apr. 3, 1984

[54] SYSTEM, APPARATUS, AND METHOD OF DISPENSING A LIQUID FROM A SEMI-BULK DISPOSABLE CONTAINER

[76] Inventors: Harold L. Nitchman, 1230 Parody, St. Charles, Mo. 63301; William B. Cunningham, Jr., 916 Woodshire La., St. Louis, Mo. 63141

[21] Appl. No.: 285,611

[22] Filed: Jul. 21, 1981

[51] Int. Cl.[3] ..... B67D 5/60; F25J 5/60

[52] U.S. Cl. ..... 222/131; 222/105; 222/183; 222/396; 220/3; 220/401

[58] Field of Search ..... 285/189; 150/8; 215/31; 248/74 R; 222/39, 64, 66, 105, 130, 131, 173, 183, 394, 396, 397, 398, 400.7; 220/401, 410, 3, 19

[56] References Cited

U.S. PATENT DOCUMENTS

| | | | |
|---|---|---|---|
| 231,597 | 8/1980 | Matthews | 222/173 |
| 2,294,118 | 8/1942 | Leary | 225/3 |
| 2,400,955 | 5/1946 | Samel | 225/15 |
| 2,673,676 | 3/1954 | Troust | 226/129 |
| 2,756,105 | 7/1956 | Magill | 299/95 |
| 2,766,899 | 10/1956 | Wallace | 215/12 |
| 2,816,691 | 12/1957 | Ward | 222/183 |
| 3,026,005 | 3/1962 | Cook | 222/105 |
| 3,061,129 | 10/1962 | Fitz Gerald | 215/11 |
| 3,087,655 | 4/1963 | Scholle | 222/183 |
| 3,117,695 | 1/1964 | Cox | 222/105 |
| 3,129,730 | 4/1964 | Simon | 222/394 X |
| 3,171,571 | 3/1965 | Daniels | 222/94 |
| 3,191,810 | 6/1965 | Johnston | 222/183 |
| 3,195,779 | 7/1965 | Nicko | 222/82 |
| 3,240,399 | 3/1966 | Frandeen | 222/211 |
| 3,243,084 | 3/1966 | Stegner | 222/95 |
| 3,292,826 | 12/1966 | Abplanalp | 222/397 |
| 3,294,289 | 12/1966 | Bayne et al. | 222/95 |
| 3,349,965 | 10/1967 | Krugger | 222/399 |
| 3,366,276 | 1/1968 | Fridley | 222/66 X |
| 3,371,822 | 3/1968 | Galloway | 222/95 |
| 3,435,990 | 4/1969 | Pike, Jr. | 222/1 |
| 3,589,506 | 6/1971 | Ford et al. | 206/46 |
| 3,752,362 | 8/1973 | Risener | 222/85 |
| 3,768,706 | 10/1973 | Hill | 222/325 |
| 3,791,557 | 2/1974 | Venus | 222/105 |
| 3,876,107 | 4/1975 | Meindl et al. | 222/64 |
| 3,876,115 | 4/1975 | Venus, Jr. et al. | 222/183 |
| 3,945,534 | 3/1976 | Ady | 222/105 |
| 3,964,636 | 6/1976 | Rehrig | 220/306 |
| 4,045,860 | 9/1977 | Winckler | 29/451 |
| 4,240,565 | 12/1980 | Croley | 222/183 X |
| 4,247,018 | 1/1981 | Credle | 222/1 |
| 4,251,032 | 2/1981 | Werding | 222/386.5 X |
| 4,265,374 | 5/1981 | Sebalos | 222/95 |

FOREIGN PATENT DOCUMENTS

| | | |
|---|---|---|
| 1268906 | 3/1972 | United Kingdom . |
| 1446338 | 8/1976 | United Kingdom . |

*Primary Examiner*—Joseph J. Rolla
*Assistant Examiner*—Michael S. Huppert
*Attorney, Agent, or Firm*—Polster, Polster and Lucchesi

[57] ABSTRACT

A system, apparatus, and method of dispensing a liquid (e.g., a beverage, a soft drink concentrate, or other flowable liquid-like material) from a semi-bulk container. The system comprises a liquid impervious container having at least one opening therein. The container is installable within a pressure containment vessel of open construction and a fitting is sealingly secured within the opening. This fitting has a port adapted to be connected to a source of pressurized gas so as to admit gas under pressure into the container and to pressurize the liquid within the container. The fitting further has a dip tube which extends down into the liquid so that liquid may be dispensed from the container via the dip tube under pressure. The presure containment vessel withstands the internal pressurization forces within the container thus permitting the use of an inexpensive, disposable container.

29 Claims, 17 Drawing Figures

SYSTEM, APPARATUS, AND METHOD OF DISPENSING A LIQUID FROM A SEMI-BULK DISPOSABLE CONTAINER

BACKGROUND OF THE INVENTION

This invention relates to a system, apparatus, and a method of dispensing a liquid-like material from a semi-bulk container, and is particularly concerned with the dispensing of such a liquid from a disposable or throw-away container.

Heretofore, many liquids, such as wine, soft drink concentrate, and the like, were pressure dispensed from a rigid wall metal container by pressurizing the container with a gas to a pressure level sufficient to force the liquid from the rigid wall container via a dip tube to a dispenser which was located remotely from the container. For example, in a restaurant, a rigid container holding a semi-bulk quantity (e.g., 1–15 gallons) of wine may be located in a refrigerated cold box and piped to a wine dispensing station conveniently located within the restaurant for ready access by restaurant personnel. In dispensing soft drinks mixed from carbonated water and concentrated soft drink syrup, the syrup is conventionally delivered to the restaurant by a soft drink bottler in a rigid, semi-bulk cannister. These cannisters are typically provided with quick disconnect fittings so as to enable a source of pressurized gas (e.g., nitrogen or carbon dioxide) to be connected to and to pressurize the interior of the rigid cannister and the liquid therein. Typically, the cannister is a reusable container sized to contain approximately 5 gallons of liquid and is constructed so as to withstand a predetermined pressure with an adequate margin of safety.

Typically, these prior art cannisters were of sturdy, metal construction, such as stainless steel or the like, and consequently were expensive. On return of these cannisters to the soft drink bottling plant, it was, of course, necessary to clean and sterilize the cannisters prior to reuse. Also, it was often necessary to repair the quick disconnect fittings and other seals on the cannisters so as to prevent leakage. Since these cannisters were reused, it was necessary for the soft drink delivery person to not only deliver filled cannisters to a customer, but the empty cannisters must be collected and reloaded on the delivery truck. In addition, it is a conventional practice of soft drink bottlers to require a deposit on the returnable cannisters and the delivery person must keep records as to the number of cannisters delivered and returned. This, of course, takes considerable time and slows down the delivery of the cannisters with consequent increased labor costs.

To overcome problems with manual pouring of beverages (e.g., wine), prior art semi-bulk wine dispensing systems have been proposed. One such system utilizes a stainless steel container into which several gallons of wine from one-gallon jugs may be poured. The container is sealed and is pressurized with nitrogen or carbon dioxide gas (depending on the type of wine to be dispensed) and the pressurized wine is pumped from the container via a dip tube to a convenient dispensing station within the restaurant where the wine may be conveniently dispensed by restaurant personnel. The semi-bulk wine container may be located remote from the serving area in a storage room or in the basement and may be kept in a refrigerated cold box. Additionally, the pressure dispensing of the wine allows automatic and accurate dispensing of predetermined quantities of the wine. More specifically, these prior art semi-bulk wine dispensing systems have utilized electronically controlled, pretimed solenoid valves which when energized will dispense a predetermined volume or quantity of wine. It will be appreciated that if the pressurizing force in the cannister remains substantially constant, and if the dispensing valve remains open for a predetermined period of time, a known quantity of wine will accurately be dispensed. The time required to dispense a desired quantity of wine (for example a liter) will be dependent on the pressure level in the cannister and the length of the hose from the cannister to the dispensing station, as well as other factors. By varying the time that the dispensing valve remains open, predetermined quantities of wine can automatically be dispensed. This is particularly advantageous because it permits a waitress to set a carafe or other container under the dispensing nozzle and to activate the dispenser and then to walk away from the dispenser to attend to other tasks while the container is filled. Since it may take several seconds to fill the container, the waitress need not stand at the container. Additionally, accurate and uniform portions will be served to all customers. No customer is "shortchanged" and the restaurant owner can readily monitor the amount of wine sold. Some prior art dispensing systems include means for keeping track of the wine served thus permitting the restaurant owner to accurately check his cash register receipts against his inventories.

However, the above described dispensing systems may be in conflict with certain state and federal laws and regulations regarding the sale and dispensing of alcoholic beverages. Generally, a bar or restaurant owner is required to dispense the alcoholic beverage from the container on which a tax stamp has been affixed. Because the above-described semi-bulk wine dispensing system required the restaurant owner to fill the semi-bulk container with wine from other containers, the wine is not dispensed from the original container on which the tax has been paid.

Because of the nature of the wine market with many major wineries being located, for example, in California, it is not practical to utilize a returnable semi-bulk container as is used in the dispensing of soft drink concentrates. In recent years, a disposable, semi-bulk wine container has been introduced. This container consisted of a leakproof bag of suitable synthetic resin material contained within a corrugated paperboard shipping box. The bag had an inlet/outlet stopper which permitted the bag to be filled. To dispense the wine, the container was installed in a dispenser in the restaurant's serving area and the inlet/outlet was connected to the dispensing nozzle of the dispenser and the container was inverted so that the outlet was at the bottom of the bag. Thus, upon opening the dispensing valve, the wine would gravity flow out of the bag. As the wine flowed out of the bag, atmospheric pressure would collapse the bag. However, because the wine was not pressured dispensed, the advantages of automatic dispensing could not be utilized. Moreover, as the bag within the shipping container collapsed, quantities of wine could be trapped in folds and creases formed in the bag. This, of course, resulted in a waste of some of the wine and thus represented a loss of income to the restaurant owner. Reference may be made to U.S. Pat. No. 3,117,695 which discloses a fluid dispensing similar to the above-described disposable gravity flow wine dispensing system.

In addition, difficulties have been encountered with dispensing other liquids and liquid-like flowable material such as lubricating grease and soft shortening. Typically, a semi-solid material, such as shortening, is delivered to a bakery in drums and the baker, utilizing a paddle or scoop, must remove a desired quantity of the shortening and weigh it on a scale before adding it to other ingredients. The time required for the baker to scoop out a quantity of the shortening, to weigh it, and to close the container represents a significant amount of time in the baking operation. It will be appreciated that oftentimes the baker may make several trips back and forth between the scale and the container of shortening until an exact desired amount of shortening has been measured out.

Reference may be made to the following U.S. patents which indicate generally prior art semi-bulk dispensing apparatus in the same general field as the instant invention: U.S. Pat. Nos. 3,371,822, 3,589,506, 3,768,706, 3,945,534 and 4,045,860.

SUMMARY OF THE INVENTION

Among the several objects and features of the present invention may be noted the provision of a system, apparatus, and method of pressure dispensing a liquid or other flowable material from a disposable, semi-bulk container;

The provision of such a system or method in which a variety of liquids or other flowable fluids may be dispensed from a disposable container under pressure wherein the container is not sufficiently strong to withstand the internal pressurization forces required to pressure dispense the liquid therefrom;

The provision of such a system in which the liquid may be accurately metered as it is dispensed so that predetermined quantities or volumes of the liquid may be readily dispensed;

The provision of such a system which permits the shipping container for the liquid to be used as the pressurization container for the liquid contained therein;

The provision of such a system which prevents the pressurization of the shipping containers without the shipping container being properly installed in a pressure containment vessel or the like which carries the pressure forces exerted internally within the shipping container upon pressurization of the liquid;

The provision of such a system which does not require personnel utilizing this system to undergo any special training or skills to utilize the system;

The provision of such a system in which the capability of the disposable container to withstand pressurization is not dependent upon the strength of the container and thus eliminates the requirement of using only containers which have adequate strength, even when wet, to withstand the internal pressurization forces;

The provision of such a system in which the container may be made in such manner that it may be shipped empty in a collapsed or knocked-down manner and which may be readily erected for filling thereby saving considerable volume in shipping of the empty containers from the container manufacturer to the party filling the container;

The provision of such a system which requires a relatively small capital investment for the party filling the containers or for the end user to utilize the system;

The provision of such a system in which substantially all of the liquid is dispensed from the container; and The provision of such a system which utilizes a container of relatively simple and inexpensive construction thereby to economically permit the container to be disposed of by the end user after use.

Other objects and features of this invention will be in part apparent and in part pointed out hereinafter.

Briefly stated, the system of this invention relates to the dispensing of a liquid from a semi-bulk container. Specifically, the system comprises a semi-bulk container of liquid impervious construction and having at least one opening therein. Means is provided which is adopted to be sealably secured within this one opening for permitting pressurization of the liquid within the container and for pressure dispensing the liquid from within the container.

The method of this invention involves filling a liquid impervious container with a liquid to be dispensed. The container is inserted into pressure containment means of open construction and the container is fitted with means for internally pressurizing the container. The internal pressurization forces are transferred to the pressure containment vessel and also exert a pressure force on the liquid within the container thereby to force the liquid out of the container via a dip tube.

Other objects and features of this invention will be apparent or will be pointed out hereinafter.

BRIEF DESCRIPTION OF THE DRAWINGS

Corresponding reference characters indicate corresponding parts throughout the several views of the drawings.

DESCRIPTION OF PREFERRED EMBODIMENTS

Figure 1:
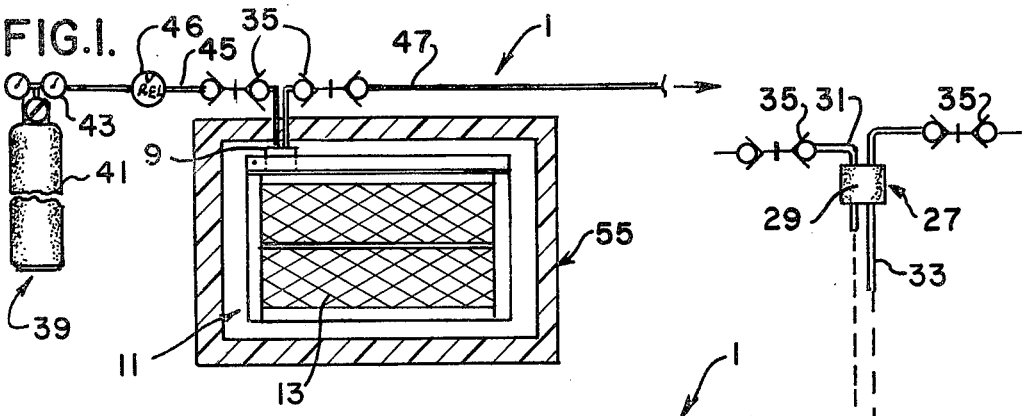
FIG. 1 is a semi-diagrammatic view of the apparatus or system of the present invention for dispensing a liquid from a semi-bulk, disposable container illustrating the semi-bulk container installed within a pressure containment vessel and further illustrating a source of compressed gas connected to the container for internally pressurizing the container and also illustrating a discharge tube for the pressurized dispensing of the liquid to a dispensing station (not shown) remote from the container, the containment vessel being illustrated within a refrigerated compartment.

Referring now to the drawings, a semi-bulk liquid dispensing system or apparatus of the present invention is shown to be indicated in its entirety by reference character 1. Generally, the liquid pressure dispensing system of this invention comprises a semi-bulk liquid container, as generally indicated at 3 in FIG. 2. The term "semi-bulk" as used herein refers to a volumetric quantity of liquid larger than an individual portion or serving of the liquid to be dispensed from the container, and yet not so large as to preclude the ready handling of the container in its intended application. For example, if the semi-bulk container 3 were intended to contain a beverage, such as wine or soft drink concentrate, the container may be sized so as to contain approximately 5 gallons (18.9 l). This permits the semi-bulk container 3 to be readily manually lifted or carried and installed in the pressure containment means of the system as will be hereinafter described. It will be understood, however, that within the broader aspects of this invention, the volumetric size of semi-bulk container 3 may vary considerably and the above-described 5 gallons (18.9 l) is merely exemplary of one convenient size of semi-bulk container.

Figure 2:
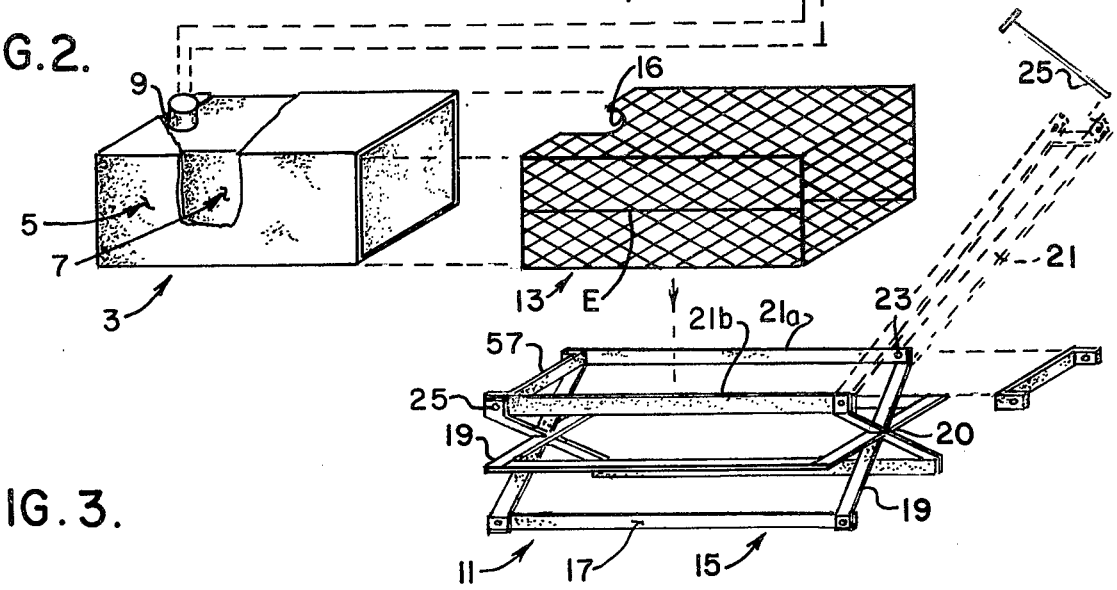
FIG. 2 is an exploded perspective view of the apparatus and system of the present invention illustrating the disposable semi-bulk container, a combination pressurization port/dip tube stopper adapted to be sealably secured within the opening of the container, and the pressure containment vessel.

As is shown in FIG. 2, container 3 comprises an outer container 5 of generally rectangular cross-section formed of a suitable material, (e.g., corrugated box board construction) so as to serve as a shipping container or a protective container. Additionally, an inner, liquid impervious container 7 is contained within outer container 5. This inner liquid container 7 may be made of any suitable material, such as a liquid impervious synthetic resin material. As shown in FIG. 2, inner container 7 is a blow molded container of a suitable plastic resin (e.g., low density polyethylene) having at least one inlet/outlet opening 9 (also referred to as an inlet/outlet fitting) extending therefrom through which liquid may be injected for filling the inner container, through which pressurized compressed gas may be introduced into the interior of the inner container thereby to pressurize the inner container and the liquid therein, and through which pressurized liquid may be discharged from the container. It will be appreciated that inner container 7 may also be made of suitable liquid impervious sheet-material, such as plastic film or the like, formed into a closed bag. Those skilled in the art will appreciate that the inner container 7 may take on any desired configuration and may be made of any one of numerous well-known liquid impervious materials, depending on the application for the inner container and depending on the liquid to be contained within the inner container. For example, in certain applications, the inner container may, instead of being a blow molded bladder or container as described above, consist of a composite synthetic resin/aluminum foil bag lined with a saran resin thereby to provide an oxygen impermeable container for permitting a long storage life of liquids, such as wine or the like, which may undergo deleterious effects upon exposure to oxygen.

Further, the semi-bulk liquid pressurized dispensing system 1 of this invention is shown to comprise a pressure withstanding containment means, as generally indicated at 11, which receives semi-bulk liquid container 3 and which withstands the majority of the pressurization loads exerted on container 3 upon pressurization of the liquid therein. In accordance with this invention, the pressure containment means 11 is shown to be of open construction so as to prevent the pressure containment means from having gas pressure sealably contained therewithin thus making the containment means a pressurized container. More specifically, containment means 11 is shown to comprise a shroud 13 of open construction, and more particularly a shroud formed of open mesh, metal construction adapted to readily, but yet snuggly, receive semi-bulk liquid container 3. It will be understood, however, that the construction of shroud 13 of mesh is merely illustrative. In some instances, construction of shroud 13 of smooth sheet metal may be preferred to aid in sliding container 3 in and out of the shroud. With the semi-bulk container 3 received within shroud 13, the shroud together with the container may be readily inserted in a rigid frame 15 for further supporting shroud 13 and the ends of container 3 whereby shroud 13 together with frame 15 effectively withstands internal pressurization forces exerted on container 3 upon internal pressurization thereof and whereby these pressurization forces are effectively transferred through the container to shroud 13 and to frame 15. It will be appreciated that, in accordance with this invention, neither inner container 7 nor outer container 5 of semi-bulk container 3 need to have sufficient structural integrity to withstand any substantial pressurization forces, but rather the pressurization forces exerted on the container are transmitted to the pressure containment means 11 thus permitting container 3 to be of relatively low strength and yet permitting the system of this invention to be capable of withstanding the internal pressurization forces. It will further be understood that pressure containment means 11 including shroud 13 and frame 15 are designed with a sufficient margin of safety to withstand the normal internal pressurization forces to be exerted within container 3 substantially without structural damage or deformation to either shroud 13 or to frame 15.

As mentioned above, shroud 13 is a generally open ended rectangular shroud of open wire mesh construction with the abutting ends, as indicated at E in FIG. 2, of the wire screening forming the shroud being positively secured (e.g., welded together) such that shroud 13 is effective in withstanding hoop stresses exerted on the shroud upon the internal pressurization of container 3. Further, shroud 13 is provided with a blind-notch, as indicated at 16, in one end thereof, for receiving inlet/-outlet fitting 9 of inner container 7 as container 3 is inserted endwise into shroud 13.

Frame 15 is shown to have a plurality of side bars 17 extending along the bottom and sides of the frame and end members 19 secured to the side bars and intersecting one another at the end faces of container 3 when the latter is installed in the frame so as to form a spider frame 20 (also referred to as a frame end) at each end of container 3. A pair of movable top frame members, **21*a*, 21*b*, are pivotally connected, as indicated at 23, at one end to the end frame members 19 at one end of frame 15 and are swingable between an open position (as shown in phantom lines in FIG. 2) in which shroud 13 together with container 3 received therein may be dropped downwardly into the open frame and a closed position (as shown in solid lines in FIG. 2) in which the movable top frame members are engageable with the top of shroud 13 and in which the free ends of the movable top members are positively secured to the end frame member 20 at the end of the frame opposite from the pivotal connections 23 by means of a removable fastener 25 thereby to lock the top frame members in their closed position and to transfer pressure forces from container 3 to frame 15 via the upper wall of shroud 13**.

Figure 3:
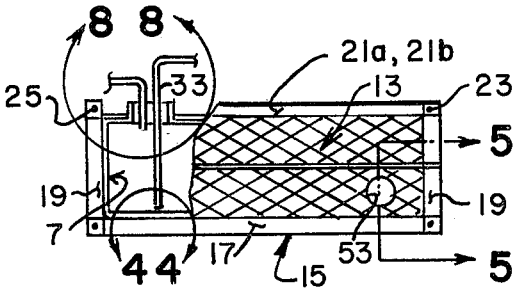
FIG. 3 is a side elevational view of the system of this invention with the disposable container installed within the pressure containment vessel and with portions of the latter broken away so as to illustrate the construction of the inlet/outlet fitting incorporating the pressurization port and the liquid dispensing dip tube.
Figure 4:
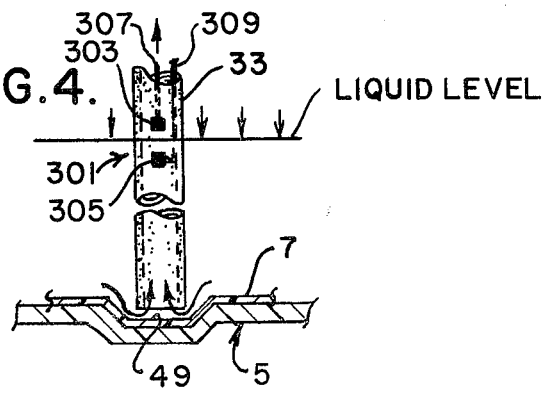
FIG. 4 is a view taken on line 4—4 of FIG. 3 in an enlarged scale illustrating the relation of the bottom end of the dip tube to the bottom of the container wherein a recess is formed in the container so as to insure that substantially all of the liquid within the container may be pressure dispensed from the container.

Further in accordance with this invention, system 1 includes a combination inlet/outlet stopper, as generally at 27, for being sealably fitted within the opening inlet/-outlet fitting 9 of inner container 7 for sealably closing the fitting. The stopper includes a body 29 received within the opening of fitting 9 and having a pressurization tube 31 and a liquid dispensing dip tube 33 sealingly secured thereto. It will be understood that with stopper 27 installed in the opening of fitting 9, pressurization tube 31 is in communication with the interior of inner container 7 and the portion of dip tube 33 extending down from stopper body 29 is of such a length as to be positioned proximate the bottom of inner container 7, as shown in FIGS. 3 and 4. Pressurization tube 31 and dip tube 33 are preferably each provided with a respective quick disconnect fitting 35 for purposes as will appear.

Figure 8:
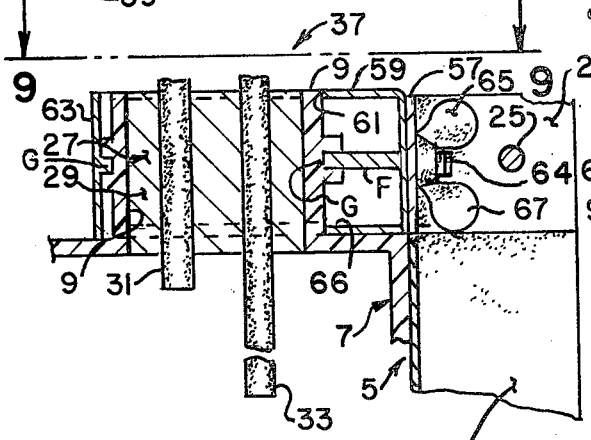
FIG. 8 is an enlarged cross-sectional view taken on line 8—8 of FIG. 3 illustrating a container having a single inlet/outlet neck with a stopper fitting inserted therein having a pressurization port and the dip tube, and further illustrating means carried by the pressure containment vessel for sealably securing the stopper in place within the container neck only when the container is installed within the pressure containment vessel.
Figure 9:
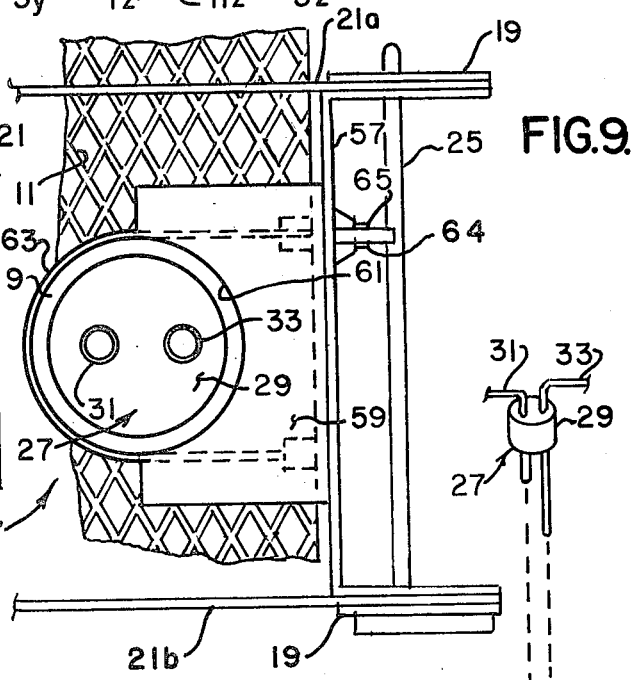
FIG. 9 is a top plan view of FIG. 8 taken along line 9—9 of FIG. 8 and further illustrating fastener means for holding parts of the pressure containment vessel in assembled position and for preventing the inadvertent loosening of the stopper securement means thereby to prevent the inadvertent release of pressure from within the container.

Referring now to FIGS. 8 and 9, system 1 is preferably provided with means, as generally indicated at 37, for sealably securing stopper 27 within fitting 9 with this securement means being carried by movable top frame members **21*a*, 21*b* and with the sealing securement means being only engageable with fitting 9 and with stopper 27 when container 3 is installed within pressure containment shroud 13 and when the latter is installed in frame 15 with the latter closed. This, in turn, prevents the container 3 being pressurized without it being installed in the pressure containment means 11**.

Further, system 1 of this invention comprises a source of pressurized gas, as generally indicated at 39, for the internal pressurization of inner container 7 by means of pressurization tube 31 on stopper body 29. As shown in FIG. 1, gas pressurization source 39 includes a bottle or other container 41 of compressed gas (e.g., carbon dioxide or nitrogen) under high pressure (e.g., 2,000 psig). A pressure regulator 43 regulates the high pressure within bottle 41 down to a predetermined pressure level which may, for example, be preset to any desired lower pressure level. For example, in dispensing a liquid such as wine from within container 3, regulator 43 may be set to regulate the pressure applied to the interior of inner container 7 to approximately 10 psig, depending on the distance the semi-bulk liquid pressurization dispensing system 1 of the present invention is located from the desired point of dispensing and other factors, such as the flow resistance of the dispensing apparatus (not shown) and the flow restriction characteristics of the piping or tubing leading from the semi-bulk container 3 to the dispensing station. In other applications, such as in the dispensing of soft drink concentrate from within container 3, a higher internal pressurization force (e.g., 45 psig) may be required so as to insure that the soda concentrate dispensed from within container 3 may be forcefully injected into carbonated water in a soft drink post-mixing apparatus of a type well-known to those skilled in the art. It will be appreciated that, depending on the desired pressures to be utilized in a particular application, the design and strength requirements of containment means 11 may be varied according to the desired pressurization level and the desired safety factor.

Pressure regulator 43 is shown to be connected to the quick disconnect fitting 35 on pressurization tube 31 by means of a pressurization line or hose 45. A pressure relief valve 46 is incorporated in the pressurization line 45. Typically, pressure relief valve 46 will be preset to relieve pressure from pressurization line 45 and from within inner container 7 at a preset pressure level somewhat above the predetermined pressurization level as determined by the setting of pressure regulator 43, but below the ultimate pressure level of container 3 within containment means 11. Additionally, pressure relief valve 46 may be provided with a selectively operable bleed valve (not shown) so as to permit the release of pressure from within container 3 upon termination of the flow of pressurization gas from bottle 41 when it is desired to relieve internal pressurization of container 3 and to remove fitting 27 from inlet/outlet fitting 9.

A dispensing line 47 is removably, sealingly connected to dip tube 33 by means of its respective quick-disconnect fitting 35 thereby to permit the container 3 to be readily connected to and to be disconnected from the dispensing line which may run a considerable distance from the location of the semi-bulk liquid dispensing system of the present invention to a dispensing head (not shown). It will be understood that by providing quick-disconnect fittings 35 for pressurization line 46 and dispensing line 47, these lines may be quickly installed on or removed from stopper 27 substantially without leakage of liquid or gas pressure. Further, it will be understood that an accumulator (not shown) may be incorporated in pressurization line 45 to accommodate pressure surges upon dispensing liquid from container 3.

As shown in FIG. 3, dip tube 33 extends down into inner container 7 and the open lower end of the dip tube is disposed proximate the bottom surface of the inner container. It will be understood that when stopper 27 is installed in fitting 9, the bottom of dip tube 33 is positioned in close proximity (almost touching) the inside face of container 7 opposite fitting 9. When the container is pressurized, the container will expand somewhat thus providing a space between the bottom of the dip tube and the container thereby permitting substantially all of the liquid to be pressure dispensed. Also, container 3 may be inclined so that the liquid flows toward fitting 9.

Further, as shown in FIG. 4, a depression or well 49 may optionally be provided in the bottom of container 7 and dip tube 33 may be of a predetermined length so that when stopper body 29 is sealably fitted within inlet/outlet fitting 9, the bottom of the dip tube extends down into the well, but yet is spaced somewhat above the bottom of the well thereby permitting pressurized liquid within the tank to flow upwardly into the dip tube and thereby to insure that substantially all of the liquid contained within container 3 is pressure dispensed from within the container leaving very little liquid which is not capable of being pressure dispensed.

Figure 5:
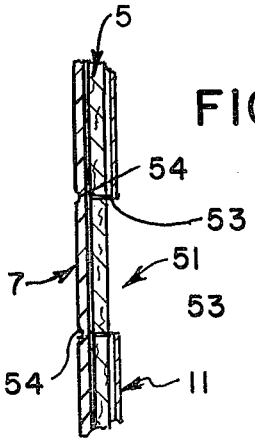
FIG. 5 is a view taken on line 5—5 of FIG. 3 illustrating in enlarged scale an area of weakness preformed in the container wherein, upon pressure forces exceeding a predetermined pressure level, the container will rupture in the area of weakness provided in the container and in the corresponding opening in the containment means thereby to relieve pressure from within the container at a predetermined level.

Referring now to FIGS. 3 and 5, means 51 for preventing over-pressurization of container 3 is provided in the system of this invention. More specifically, this over-pressurization preventing means is shown to comprise an unsupported opening 53 in shroud 13. Specifically, this opening 53 in shroud 13 is so sized that a predetermined area of outer container 5 and of inner container 7 is not supported by pressure containment means 11 such that when the internal pressurization forces within container 7 exceed a predetermined value, local bursting of container 3 will result in the area of opening 53 thereby releasing pressure from within the container at a desired location and in a desired direction so as to minimize damage to pressure containment means 11 and to prevent injury to surrounding property or personnel. It will be understood by those skilled in the art, that the portion of container 3 adapted to be in register with opening 53 may be constructed to have predetermined lines of weakness 54 therein so that the portion of container 3 in register with opening 53 constitutes a blowout disk or safety relieve disk.

Referring again to FIG. 1, it will be understood that, in accordance with the system and method of this invention, the semi-bulk container 3 together with its pressure containment means 11 may be installed in a refrigerated compartment 55 at some distance remote from the desired dispensing station (not shown). Thus, semi-bulk beverage containers 3 in their respective pressure containment means 11 may be located in a cold room in an area remote from the serving location for the beverage. In a restaurant, containers 3 containing bulk wine may be located in a back storage room or even in the basement of the restaurant. Likewise, in fast food restaurants, containers 3 containing supplies of soft drink concentrate, may be located in the basement or in an adjoining storage room thereby to leave the serving area of the restaurant free of large numbers of soft drink containers and eliminating the necessity of interfering with the food serving activities of the restaurant personnel upon changing of the soft drink concentrate containers.

Again referring to FIGS. 8 and 9, means 37 for sealably securing stopper 27 in place within inlet/outlet fitting 9 of inner container 3 will now be more particularly described. As indicated at 57, a crossbar is secured to and extends between the top frame members **21*a*, 21*b* of frame 15. A bracket 59 is rigidly secured (welded) to the inner face of crossbar 57 and this bracket 59 is provided with a U-shaped opening 61 therein adapted to mate with and to engage at least a portion of fitting 9 when the movable frame support bars 21*a*, 21*b* are in their lowered position and when locking pin 25 securely fastens the outer ends of the movable frame arms 21*a*, 21*b* to the end frame members 19 when the top frame members are in their lowered, secured positions. Preferably, fitting 9 is provided with a circumferential groove G (see FIG. 8) therearound defined by a pair of spaced shoulders and bracket 59 is provided with a flange F which is received in groove G thereby to restrain axial (i.e., in and out) movement of fitting 9 relative to inner container 7 and to bracket 59. A flexible strap 63 is secured at one end to bracket 59 with this strap extending around the side of fitting 9 opposite that received in U-shaped opening 61 of bracket 59 and the outer end of strap 63 terminates in a threaded stud 64 which protrudes outwardly from an apperture (not shown) in crossbar 57. A wing nut 65 or other threaded fastener threadably engages the portion of stud 64 extending out through crossbar 57. Upon tightening wing nut 65, strap 63 is drawn into firm engagement with fitting 69 and the fitting is in turn circumferentially compressed between the strap and the portions of bracket 59 defining opening 61 and flange F thereby to sealably engage stopper body 29 inserted within the opening of fitting 9. In this manner, upon tightening wing nut 65 and compressing fitting 9, the stopper body 29 is positively and sealably held within fitting 9. As explained above, flange F cooperates with groove G to restrain axial movement of fitting 9**.

Additionally, bracket 59 has a lower plate 66 engageable with the portion of inner container 7 adjacent fitting 9 thereby to support the inner container proximate fitting 9 and to enable the container to better withstand internal pressurization forces. It will be understood that plate 66 thus constitutes means carried by the movable portion of frame 15 engageable with the container 7 proximate the fitting 9 for locally supporting the container.

As is best shown in FIG. 8 and 9, with wing nut 65 tightened so as to sealably secure fitting body 29 within fitting 9 and with lock pin 25 inserted so as to positively secure frame members 21*a*, 21*b* in their lowered locked position relative to end frame members 19, lock bar 25 is positioned relative to wing nut 65 so as to effectively prevent turning of the wing nut any appreciable degree thereby preventing loosening of means 37 sealably securing the stopper body within fitting 9. This, in turn, effectively prevents the release of the stopper from within fitting 9 while container 3 is pressurized since it is difficult to remove the lock bar from the frame members while the frame members 21*a*, 21*b* are transferring any appreciable pressure load from container 3 to the end frame members 19. Before pin 25 can be withdrawn, gas pressure within container 7 must be released via the bleed valve incorporated in relief valve 46. For example, this bleed valve may constitute the spring-loaded relief valve having a finger pull ring manually actuable to release pressure from within container 7.

It will be appreciated by those skilled in the art that other arrangements for sealably securing stopper 27 to fitting 9 may be employed. For example, stopper 27 may be formed in the shape of a screw cap which threadably engages screw threads formed either on the exterior or the interior of fitting 9. Further, within the broader aspects of this invention, while container 3 has been shown to have a single inlet/outlet fitting 9 with the pressurization line 31 and with the liquid dispensing dip tube 33 being contained within a single stopper 27, container 7 may be provided with separate openings, one for pressurization of the liquid and one for the dispensing of the liquid. In certain applications, such as in the dispensing of paste-like, semi-liquid materials (e.g., lubricating grease or the like), it may be desirable to have the pressurization opening for container 3 at the top and for having the dispensing outlet opening at the bottom of the container. As used in the specification and claims of this application, the term "at least one inlet/-outlet opening" shall include both a single opening, as shown in the drawing figures, and also the provision of such containers which have multiple openings in the container with at least one of the fittings being provided for pressurization of the contents of the container and with another of the openings being provided for dispensing of the contents of the container.

Referring again to container 3 shown in FIG. 2, inner container 7 was defined to be a liquid impervious, bladder-type container capable of holding a predetermined volume of liquid and capable of being sealed so as to permit the internal pressurization of the container with consequent pressurization of the liquid therein. As noted above, inner container 7 may be of a pliant synthetic resin material (e.g, a blow molded plastic bottle or a plastic film bag) while the outer container was defined as being a corrugated fiberboard box. It will be appreciated that the main purpose of inner container 7 is for the sealable containment of the liquid and for the leak-tight pressurization of the liquid contained therein. The primary function of outer container 5 is that of a shipping container providing adequate strength support and protect the inner container against damage (e.g., puncture) during shipping and storage of container 3.

It will be further understood that, in accordance with the broader aspects of this invention, outer container 5 need not contribute substantially to the capability of container 3 to withstand internal pressurization forces. Instead, pressure containment means 11 engageable with the sides and ends of container 3 is intended to effectively have the pressure loading of the system transferred thereto and to withstand all (or substantially all) of the pressure forces. Thus, even though outer container 5 may be made of a relatively inexpensive material, such as corrugated fiberboard, the container may be utilized even in the event the outer container gets wet and looses a substantial portion of its strength. This permits the use of a relatively weak, inexpensive container for use in pressure dispensing of the contents of the container and enables the end user to economically dispose of the container after use.

Figure 6:
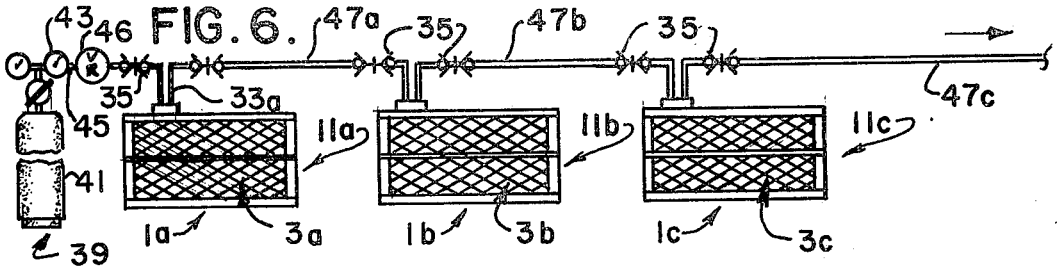
FIG. 6 is a semi-diagrammatic view illustrating a plurality of semi-bulk containers of the present invention installed within their respective pressure containment vessels and pressurized by a single source of pressurized gas with the respective semi-bulk containers being connected in series so that a large volume of the liquid contained within the individual semi-bulk containers may be dispensed.

Now referring to FIG. 6, a number of pressure dispensing units, of the present invention, as generally indicated at 1*a*, 1*b* and 1*c*, are shown connected in series to one another and each being internally pressurized by means of a single gas pressurization source 39 whereby the contents of all of the containers 3*a*, 3*b*, and 3*c* may be dispensed via a single dispensing line 47*c*. In this manner, a relatively large volume of liquid may be dispensed without the necessity of having to relieve pressure from the system and to replace empty containers. It will be understood that as gas pressure flows from bottle 41 via line 45 into the first container 3*a*, this first container becomes internally pressurized and that the liquid forced out of the first container via its dip tube 33*a* and dispensing line 47*a* becomes the pressurization force exerted on the next container 3*b*. Likewise, the liquid dispensed from the second container 3*b* via its dip tube 33*b* and dispensing line 47*b* serves to pressurize the liquid within the third container 3*c*. This in series connection of containers 3*a*, 3*b*, and 3*c* each containing the same type of liquid is particularly advantageous in busy restaurant applications (e.g., fast food restaurants) because at the beginning of the day, an adequate supply of liquid (e. g., soft drink concentrate) can be hooked up to the remote dispensing units thereby preventing (or reducing) the possibility of the restaurant from inadvertently running out of the liquid being dispensed, particularly at critical busy periods.

Figure 7:
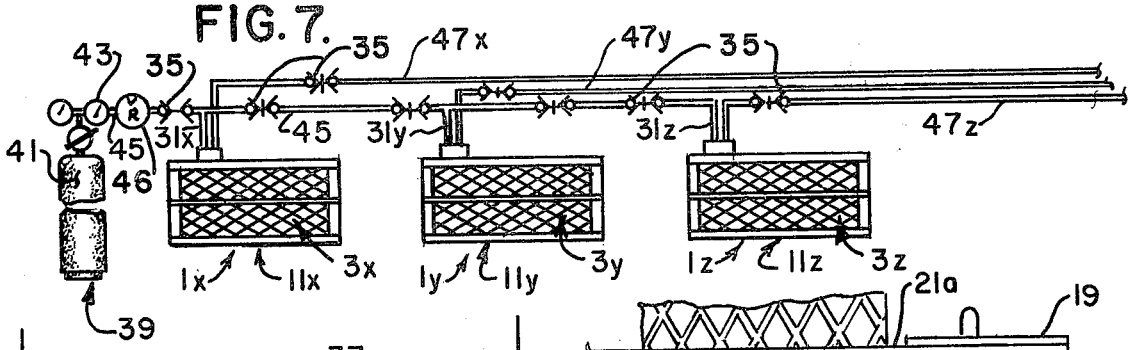
FIG. 7 is a view similar to FIG. 6 illustrating a plurality of independent semi-bulk containers of the present invention pressurized by a single pressurization source, but independently dispensing the liquids from within each of the individual containers through a respective dispensing line.

In FIG. 7, an alternative arrangement for the connection of a number of semi-bulk liquid pressurized dispensing systems of this invention is illustrated in which systems 1x, 1y, and 1z including respective containers 3x, 3y, 3z are shown connected in parallel to a single pressurization source 39 and in which a single pressurization line 45 is connected to pressurization ports 31x, 31y and 31z leading into each of the containers thereby to pressurize the liquid contents of each of the containers. The dip tubes 33x, 33y and 33z of each of the containers is each connected to a respective liquid discharge tube 47x, 47y, or 47z whereby the liquid for each of the containers 3x, 3y or 3z may be dispensed via its respective dispensing line. In this manner, multiple kinds of liquid (e.g, different kinds of wine or soft drink concentrate) may be selectively dispensed from their respective containers and yet only a single pressurization source 39 is required.

Figure 10:
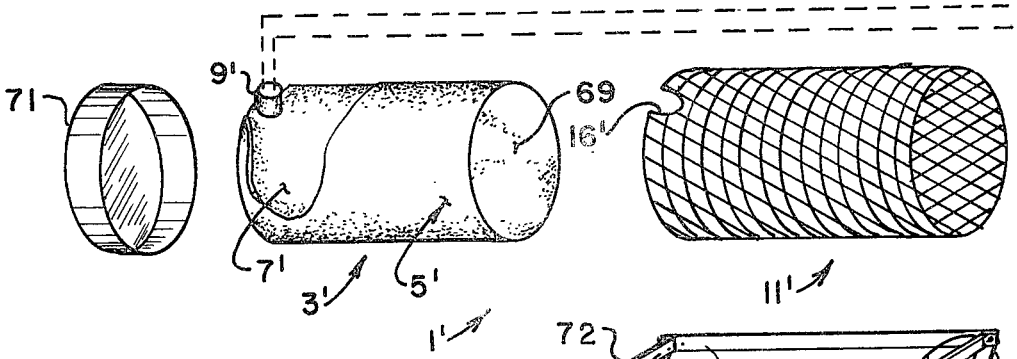
FIG. 10 is an exploded diagrammatic view of another embodiment of the system and apparatus of the present invention generally similar to the system illustrated in FIG. 2, except that the container and the pressure containment vessel are of cylindric construction.
Figure 10:
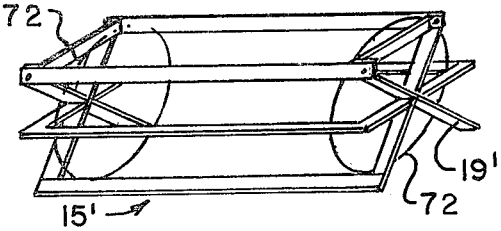

Referring now to FIG. 10, another embodiment of the pressurization system of this invention is indicated in its entirety by reference character 1'. In this embodiment, primed reference characters indicated corresponding parts having a similar construction and function to the corresponding parts described above in regard to the embodiment shown in FIGS. 1-9. Specifically, this second embodiment utilizes a cylindric container 3' having a cylindrical outer container 5' and an inner cylindrical container 7'. For example, outer container 5' may be a fiber drum of wrapped paper construction having an integral bottom 69. An over fitting cover or cap 71 is adapted to be telescopically fitted on the open end of outer container 5' after the inner container 7' has been inserted in outer container 5'. As shown in FIG. 10, inner container 7' has an inlet/outlet filler neck 9' extending out the side of the inner container and it will be appreciated that outer container 5' may have a blind-notch (not shown) adjacent the open mouth thereof to receive filler neck 9'. It will further be understood that this blind notch permits the filler neck to be positioned from the open mouth of the outer container 5' a distance sufficient so as to permit over fitting lid 71 to fit snuggly down on the outside of the open end of the outer container. Further, it will be understood that over fitting cap 71 may also have a blind notch (not shown) therein adapted to receive fitting 9' when the latter is extended. Cap 71 may be secured in place on outer container 5' by means of a suitable adhesive applied to the inner surface of the over fitting cap or by a piece of tape (not shown) wrapped around the portion of the over fitting cap and an adjoining portion of the outer surface of the outer container. In this manner, tension loads applied on the cap upon internal pressurization of the inner container will be transferred to the outer container 5'.

Further, cylindric pressure containment shroud 11' is shown to have a blind notch 16' in one end thereof for reception of the filler neck 9' in the same manner as described above in regard to the embodiment shown in FIG. 2. Frame 15' is substantially identical in construction and operation to frame 15 described above in regard to FIG. 2. However, frame 15' is shown to include an optional end plate 72 secured to the inner face of each of the end frame members 19' to engage the outer ends 69 of outer container 5' and the outer end face (not shown) of the over fitting lid 71 thereby to more effectively transmit the internal pressurization forces exerted on the ends of container 3' to frame end 19'. It will be understood that these end plates 72 may be also used on frame 15 illustrated in FIG. 2 and may be preferred.

Figure 11:
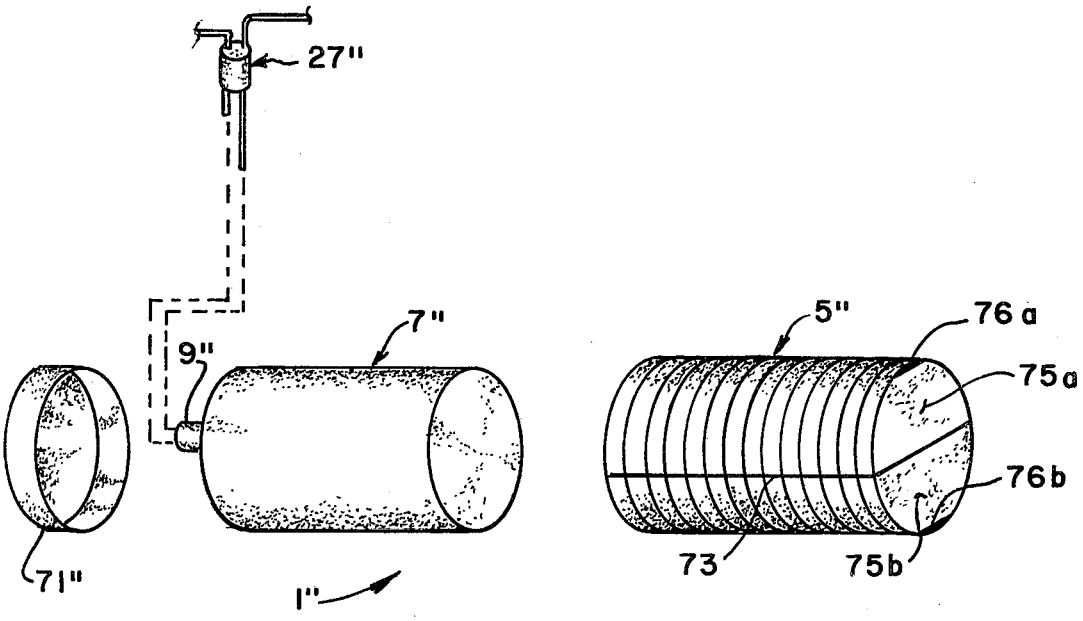
FIG. 11 is a view similar to FIG. 10 in which the container consists of an inner liquid impervious container adapted to be fitted with the inlet/outlet stopper as described above and, in which the inner container is received within a disposable outer container and in which both the inner and outer containers may be readily inserted in a frame with the outer container having sufficient strength to withstand internal pressurization forces and to distribute the pressurization forces to the frame, and in which the outer container and the inner container are made of collapsible construction so that they may be shipped in knocked-down configuration from the container manufacturer to the filler of the container.

Referring now to FIG 11, another variation of the system of the present invention is illustrated and is identified by reference character 1". This other embodiment comprises a cylindric outer container 5" and over fitting lid 71" similar in construction to outer container and lid shown in FIG. 10. Inner container 7" is shown to be blow molded plastic bladder or bottle adapted to fit within outer container 5". However, the inner container has a inlet/outlet filler neck 9" extending endwise therefrom and adapted to fit through an opening (not shown) in the end face of lid 71 so that the filler neck extends through the lid when the lid is installed in place. It will be appreciated by those skilled in the art that fitting 9" is adapted to fit readily between end frame members 20" of end frame 19". Similarly, a combination inlet/outlet stopper 27" may be sealingly fitted in filler neck 9" in a manner similar to that described above in regard to the other containers 3 and 3' heretofore described.

In regard to the cylindric drum of wrapped paper construction shown in FIGS. 10 and 11, the cylindric shape of the outer containers 5' and 5" contribute significantly to the ability of container 3' or 3" to withstand internal pressurization of inner container 7' or 7". It will be appreciated that, in certain instances and with certain types of outer container construction, the wire mesh the cylindric shroud 11' shown in FIG. 10 may be omitted and the cylindric container 5' may be inserted directly in the open construction frames 15' or 15" whereby the frame is of sufficient strength to withstand the pressurization forces of the container. Still further, it will be understood that the cylindric cross section outer container 5' may be constructed with a slight draft or taper thereby to permit the empty outer containers to be stacked or nested within one another for more compact shipment to the point of use or filling of the container.

Referring to FIG. 11, outer container 5" is generally of cylindric shape. As indicated at 73, however, fold or score lines extending longitudinally of the outer container are provided therein whereby the cylindric outer container may be folded flat along fold lines 73 thereby permitting the outer container to be shipped prior to use in a knocked-down or folded position thereby to conserve space. This knock-down cylindric outer container includes bottom flaps 75a, 75b hingedly attached to opposite sides of the container, as indicated at 76a, 76b, respectively, which may be folded closed upon erecting the container to is cylindric shape. These bottom flaps 75a, 75b may, for example, be taped or otherwise secured to one another to constitute a closed end for container 5". Upon use, container 5" may be erected by forcing the fold lines 73 inwardly so that the outer container assumes substantially a cylindric shape thereby to receive the inner container 7". Alternatively, container 5" may be open at both ends (i.e., flaps 75a, 75b may be omitted) and an over fitting lid 71" may be secured to each of its ends thereby to support the ends of inner container 7".

Referring again to the embodiment shown in FIG. 2, it will be understood that the rectangular outer container 5 of corrugated fiberboard construction is particularly advantageous because the outer container may be shipped to the user of the container in a flat or knocked-down state thereby to substantially decrease the volume occupied by the empty containers 3. The inner container or bladder 9 may be either blow molded on site in a suitable blow molding machine, or may be shipped to the manufacturer in a compact, folded position. Upon use, the outer container 5 is erected and the inner container or bladder 7 is inserted therein. Suitable flaps on the outer container may be secured in place (e.g., stabled or adhesive bonded to one another) to suitably enclose the inner container.

Figure 12:
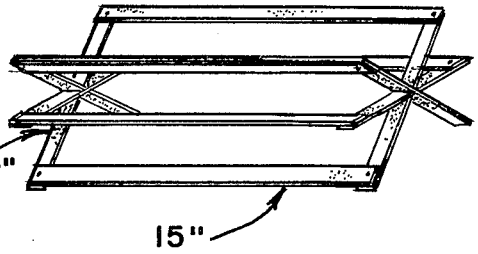
FIG. 12 is an exploded perspective view of still another embodiment of the system of the present invention consisting of a liquid impervious inner container having a collapsible spout extending from one end thereof into which the inlet/outlet stopper is adapted to be fitted and with the inner container adapted to be received in a disposable, outer container of sufficient strength to withstand the internal pressurization forces whereby the outer container comprises the pressure containment means.
Figure 12:
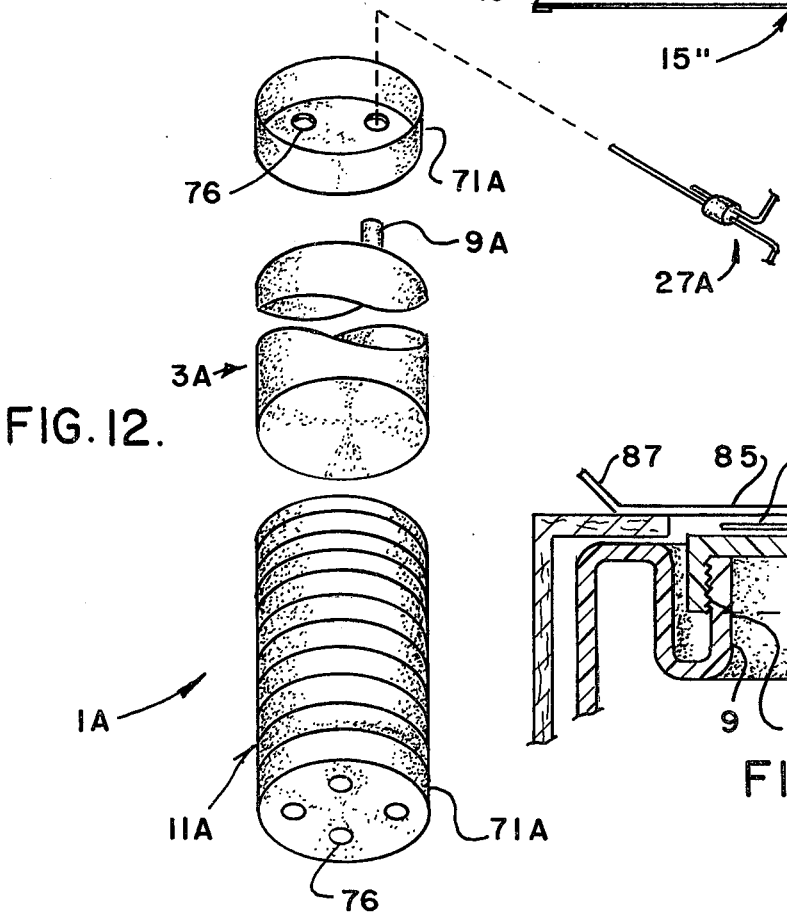

In FIG. 12, still another embodiment of the pressure dispensing system of the present invention is shown to be indicated in its entirety by reference character 1A. This system includes a cylindric container 3A generally similar to inner container 7" shown in FIG. 10. However, the pressure containment means 11A of this embodiment is shown to be constituted by outer container 5A which is so constructed as to be capable of withstanding substantial pressure forces exerted thereon upon the internal pressurization of container 3A which is received within containment means 11A. As shown, over fitting end caps 71A are provided at each end of containment means 11A and are secured-in-place relative to the containment means after container 3 has been inserted therein in such manner as to effectively transfer tension pressure loads from lids 71A to containment means 11A. Container 3A has a filler neck 9A extending endwise therefrom adapted to be received in a corresponding opening (not shown) in the end face of its respective lid 71A. A stopper 27A is provided for being sealingly secured within fitting 9A in a manner similar to that heretofore described. Because the above-described opening in lid 71A does not sealably engage fitting 9A, gas pressure may not build up within containment means 11A (unless enclosed within container 3A) and thus container 11A may be said to be of open construction. Additionally, openings 76 may be provided in the end faces of lids 71A to further insure gas pressure cannot build up within containment means 11A.

Figure 13:
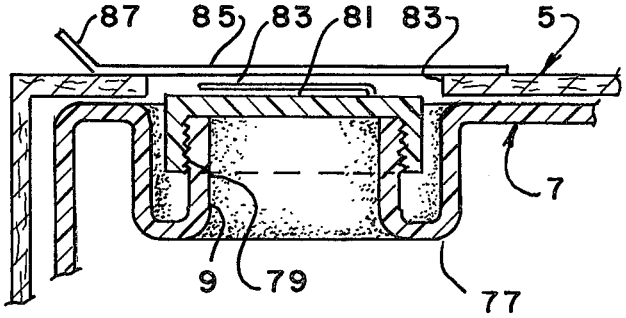
FIG. 13 is an enlarged cross-sectional view of a portion of the container generally as shown in FIG. 3 with the inlet/outlet opening of the container in a retracted position in which it is substantially retracted within the container so that the outer surfaces of the container are substantially flush, in which the opening is sealably closed by a suitable lid or cap, and in which a tear-away strip is provided for enabling access to the retracted, sealed opening, the opening nozzle being readily extendable from its retracted position shown in FIG. 13 to an extended position as shown in FIG. 3.

Referring now to FIG. 13, an enlarged view of a portion of the container 3 shown in FIG. 2 is illustrated including the portion of the container incorporating inlet/outlet fitting 9. As illustrated in FIG. 13, the filler neck 9 is integrally connected with inner container 7 by means of a rolling diaphragm-type neck 77. The filler neck may be provided with external threads 79 and a screw cap 81 may be threadably, sealingly screwed onto the filler neck thereby to close and to seal the contents within inner container 7. A finger hold 83 (shown in stowed position) may be provided on the upper surface of screw cap 81 thereby to permit the user to readily grasp the finger hold and to pull the filler neck 9 from its folded, stowed position (as shown in FIG. 13) to an extended position (as shown in FIG. 2) in which the neck extends outwardly through an opening 83 (see FIG. 13) provided in outer container 5. A removable cover 85 overlies and covers opening 83 thereby to seal dust and dirt out of the inner container. Cover 85 is provided with a finger tab 87 permitting the user to readily grasp the cover and to tear it away from outer container 5 for uncovering the filler neck 9 and cap 81. In this manner, with the filler neck 9 in its retracted or stowed position, the containers 3 may be readily stacked on one another without interference or damage to their filler necks 9.

In operation, a user of the system or apparatus of this invention fills inner container 7, when installed in outer container 5, with a suitable liquid to be dispensed, and seals the inlet/outlet opening 9 by means, for example, of the screw cap 81, as shown in FIG. 13. The filler neck is then pushed inwardly to its retracted position and the cover strip 85 is applied over opening 83 in outer container 5 thereby to seal and enclose the filler neck. The filled semi-bulk containers 3 are then transported or shipped to the end user and, due to the compactness of the semi-bulk containers, they may be readily transported and stored until ready for use. The end user grasps the finger hold 87 of cover 85 and rips the cover free of opening 83 thereby exposing the cap 81 and manually grasps ring 81 and pulls the filler neck 9 to its extended position, as shown in FIG. 2. Container 3 is then inserted in (i.e., slid axially into) pressure containment shroud 13 so that filler neck 9 is received in slot 16 in the shroud. Then, container 3 together with the pressure shroud is then installed in frame 15. The upper frame members **21*a*, 21*b* are then swung from their open position (as shown in dotted lines in FIG. 2) to their closed position and locking bar 25 is inserted through the apertures provided in the end frame members and in the outer ends of members 21*a*, 21*b* thereby to lock the swingable frame members to the end frames and to securely hold the shroud within the frame. Then, screw cap 81 is removed from the filler neck and stopper assembly 27 is fitted within the inner bore of the filler neck 9 in the manner generally shown in FIG. 8. With the stopper so installed, dip tube 31 extends downwardly into the liquid contained within inner container 7 and is disposed slightly above the bottom wall of the container as shown in FIG. 3 and 4. Then, flexible strap 63 is tightened around the outside of the filler neck by means of wing nut 65 thereby sealably securing stopper body 29 within the filler neck 9 so as to seal the stopper body relative to the filler neck. Dispensing line 47 is then connected to dip tube 33 and pressurization line 45 is connected to pressurization line 31 by means of quick-disconnect fittings 35. After the dispensing line 47 and the pressurization line 45 have been connected to their respective dip tubes and pressurization tubes, the valve on gas bottle 41 is opened and gas pressure regulated to a predetermined pressure level by gas pressure regulator 43 is admitted into the interior of inner bag 7 thereby to pressurize the inside of the bag and the liquid contained therewithin. This internal pressurization forces liquid out of the bag via dip tube 33 for discharge to a remote location via dispensing line 47. It will be understood that pressure relief valve 46 will prevent overpressurization of the container 3**, and, upon depressurization of the container, pressure from within the container may be relieved by means of the bleed valve (not shown) incorporated in the relief valve.

It will be understood that the construction of container 3 may be relatively inexpensive, due primarily to the fact that the container itself need not withstand the internal pressurization forces, thus permitting the empty container to be economically disposed.

Further in accordance with this invention, it will be appreciated that in certain applications, outer container 5 may be omitted and inner container 7 may be inserted directly in pressure containment means 11 (i.e., shroud 13) whereby the pressure forces within container 7 are transmitted directly to the pressure containment shroud.

In accordance with the method of this invention, a liquid or other flowable, liquid-like material may be dispensed from a semi-bulk, disposable container 3 by first filling the container with the liquid to be dispensed. Then, means, such as stopper assembly 27, is inserted into the inlet/outlet opening of the container for permitting pressurization of the liquid within the container and for permitting dispensing of the pressurized liquid from therewithin. The container is inserted with a containment vessel or structure 11 of generally open construction thereby to withstand and transfer the pressurization forces exerted on the container. Then the container within the containment vessel is pressurized to a predetermined pressure level by, for example, a pressurization source 39 via a pressurization line 45, thereby to pressurize the liquid inside the container. The pressurized liquid is dispensed from within the container via a dispensing line 47 connected to the opening (i.e., connected to dip tube 33).

Figure 14:
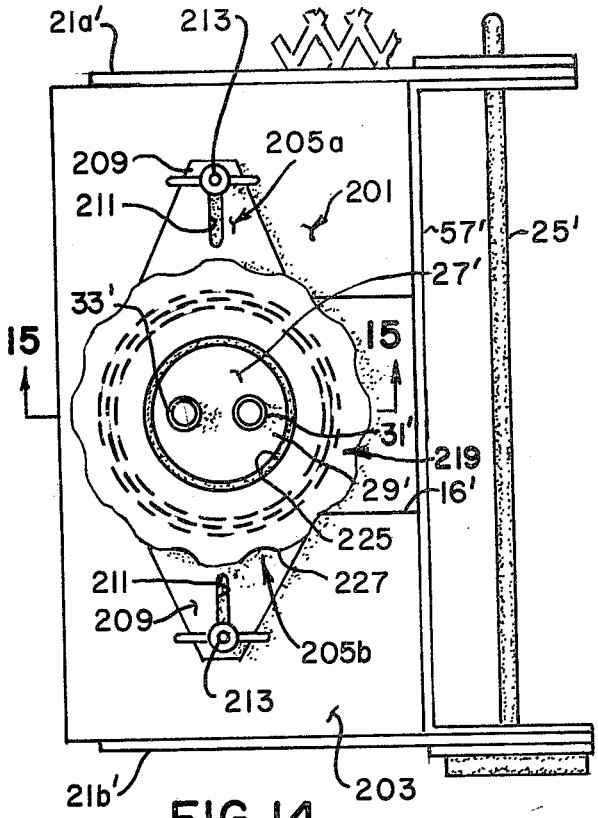
FIG. 14 is a view similar to FIG. 9 illustrating an alternative system for supporting the opening of the container when the latter is pressurized and for sealably securing the pressurization port/dip tube stopper in the container opening.
Figure 16:
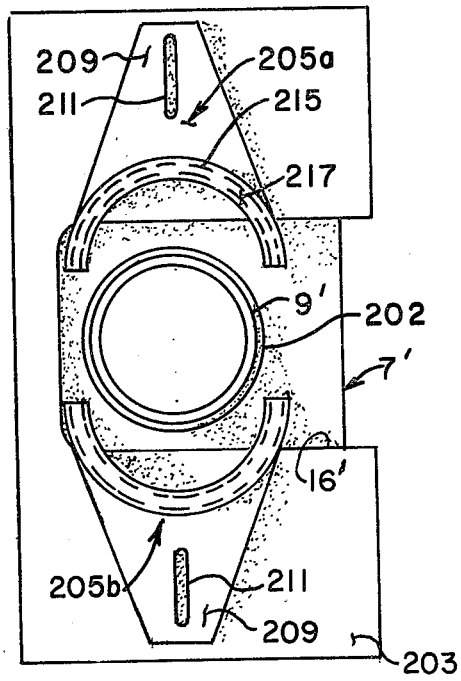
FIG. 16 is a view similar to FIG. 14 showing a support plate with a blind notch therein for reception of the container opening and showing the opening support members in their open position so as to enable a container opening to be inserted therein, the container opening, stopper, and support screw cap shown in FIGS. 14 and 15 being omitted for clarity.
Figure 15:
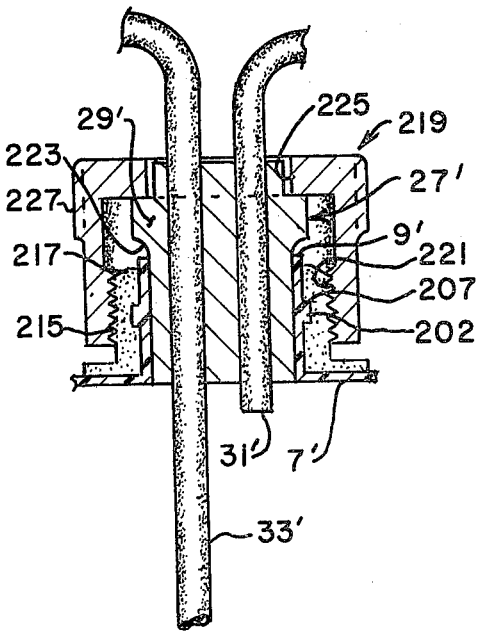
FIG. 15 is a cross-sectional view of the system illustrated in FIG. 14 taken along line 15—15 of FIG. 14.

Referring now to FIGS. 14–16, an alternative stopper securement means, as indicated generally at 201, is shown. This alternate stopper securement means is similar in certain respects to means 37 heretofore discribed. Corresponding parts having corresponding functions are indicated in FIGS. 14–16 by "primed" reference characters.

In FIGS.14–16, container 7' has an inlet/outlet opening 9'. Container 7' may be a bag or a flexible container and opening 9' may be moved between a retracted position, such as shown in FIG. 13, and an extended position. Opening 9' includes and outwardly extending, circumferential flange 202 extending therearound. A reinforcing plate 203 is secured to containment vessel 13'. This plate has a blind notch 16' therein for reception of opening 9' as the container 3' is slid endwise into the containment vessel.

Plate 203 has a pair of opposed collar halves **205*a*, 205*b* slidably mounted thereon movable between an open position (as shown in FIG. 16) in which a container opening 9' may be received in notch 16' and a closed position in which the collar halves 205*a*, 205*b* each have a respective groove 207 on its inner face for receiving flange 202 on opening 9' as the collar halves move to their closed positions thereby to firmly support the opening 9' and to prevent it from moving in axial direction. Each collar half has a respective flange 209 thereon with a slot 211 therein. A stud 213 is secured to and extends from plate 203 for reception in the slot 211 thereby to restrain movement of the collar halves between their open and closed positions. Collar halves 205*a*, 205*b* each have external threads 215 and a upper end 217**.

A screw cap 219 having internal threads 221 therein threadably engages threads 215 on collar halves **205*a*, 205*b* when the latter are in their closed opsition. A stopper 27' is fitted into the bore of opening 9' and carries a pressurizing tube 31' and a dip tube 33'. Stopper 27' has a stopper body 29' with the latter having a shoulder 223 engageable with the upper edge of opening 9' thereby to sealably compress the opening 9' between stopper body 29 and collars 205*a*, 205*b* thereby to positively seal the stopper with respect to container opening 9'. It will be also understood that since shoulder 223 is engageable with the upper edge of opening 9', this serves to accurately locate the lower end of dip tube 33' relative to the lower inside face of inner container 7' so that upon pressurizing the container, the end of the dip tube is located in close proximity to the inside surface of the inner container thereby to insure that substantially all of the liquid in the container can be dispensed via the dip tube. Preferably, the lower end of dip tube 33' is located within about 1/16 inch of the inside surface on the inner container. Of course, it will be understood that a depression or well 49' may be provided in the container wall opposite opening 9' for the lower end on dip tube 33'**.

Cap 219 has a central aperature 225 through which stopper 27' may extend. Cap 219 further has a knurled outer surface 227 thereby to permit it to be manually tightened and loosened from collar halves **205*a*, 205*b*** without using even simple hand tools.

It will be understood that since collar halves **205*a*, 205*b* are mounted on plate 203 which in turn is carried by containment vessel 13', and since stopper 27' is sealably secured to the container opening solely by the cooperation of the collar halves and cap 219, it would not be possible to sealably install stopper 27' in opening 9' unless container 3' were first installed in the pressure containment means 11'**.

Figure 17:
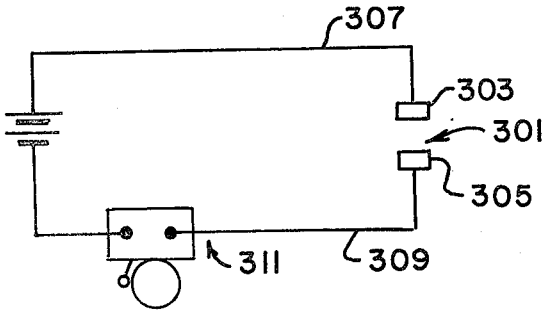
FIG. 17 is an electrical schematic of a sensor carried by the dip tube for generating a signal in response to the liquid level dropping below a predetermined level.

Referring now to FIGS. 4 and 17, means, as indicated generally at 301, is provided for generating a signal in response to the level of the liquid dropping below a predetermined level within container 7 thereby to alert personnel that the nearly empty container should be exchanged for a full container. This alarm means 301 is shown to comprise a first electrode 303 mounted on dip tube 33 at a desired location thereon and exposed to the liquid within container 7. A second electrode 305 is mounted in close proximity to electrode 305 and it too is exposed to the liquid. Preferably there is only a small vertical separation between electrodes 303 and 305 and the electrodes are located near the lower end of dip tube 33. Electrodes 303 and 305 are connected to a low voltage source of power, (e.g., a 9 volt battery) by respective wires 307 and 309. An alarm bell or other signal generating means 311 is connected in series to electrode 305 and the battery. This bell is normally de-energized when current is flowing therethrough, but, upon interruption of the current, is energized thereby to generate a signal and to sound an alarm. Bell 311 is energized upon the liquid level dropping below the level of electrode 303 thereby breaking the circuit between electrodes 303 and 305.

In view of the above, it will be seen that the several objects and features of this invention are achieved and other advantageous results obtained.

As various changes could be made in the above constructions and methods without departing from the scope of the invention, it is intended that all matter contained in the above description or shown in the accompanying drawings shall be interpreted as illustrative and not in a limiting sense.

What is claimed is:

1. A system for dispensing of a liquid from a container containing a supply of said liquid therein, said container being of liquid impervious construction and having at least one opening therein, means sealably cooperable with said at least one opening of said container for permitting pressurization of said liquid within said container and for pressure dispensing said liquid from within said container, and pressure containment means for receiving and for withstanding pressure forces exerted on said container during dispensing of said liquid from therewithin said pressure containment means comprising a containment vessel incapable of sealably holding gas pressure therewithin for receiving said container and a frame into which said containment vessel with said container received therein is removably installed, said container having axial and circumferential pressure forces applied thereto when internally pressurized, said frame at least in part carrying said axial pressure forces applied to said container and said containment vessel at least in part carrying said circumferential pressure forces and substantially limiting expansion of said container upon internal pressurization of said container.

2. A system as set forth in claim 1 further comprising a dip tube inserted into said container via one of said openings and sealed with respect to said container whereby pressurized liquid within said container is forced out of said container via said dip tube.

3. A system as set forth in claim 1 further comprising a source of pressurized gas for effecting pressurization of said liquid within said container at a predetermined pressure level.

4. A system as set forth in claim 1 wherein said container includes an outer protective container and inner container, said inner container being of liquid impervious material.

5. A system as set forth in claim 1 wherein said frame includes at least one frame member removably secured to said frame and being movable from an open position in which said containment vessel together with said container therein may be inserted in and removed from said frame and a closed position in which said at least one frame member is secured to said frame thereby to prevent removal of said containment vessel from said frame and to withstand a portion of the pressurization loads exerted on said container.

6. A system as set forth in claim 5 further comprising means carried by said at least one frame member cooperable with said at least one opening of said container for sealably securing said pressurization means within said at least one opening only when said container is installed within said pressure containment means.

7. A system as set forth in claim 1 wherein said container is unsupported by said containment means in a predetermined area thereby to constitute an area of weakness in said container so that in the event pressure within said container exceeds a predetermined pressure limit, said unsupported portion of said container will rupture thereby to release pressure from within said container.

8. A system as set forth in claim 1 wherein said container opening comprises a neck integral with said container and projecting out from said container, said container being insertable into said containment means, the latter having means therein for receiving said neck as said container is inserted into said containment means with said neck being accessible from the exterior of said containment means.

9. A system as set forth in claim 1 wherein said means sealably cooperable with said container opening is means carried by said pressure containment means and is sealably cooperable with said container opening only when said container is installed in said pressure containment means.

10. A system for dispensing of a liquid from a container containing a supply of said liquid therein, said container being of liquid impervious construction and having at least one opening therein, means sealably cooperable with said at least one opening of said container for permitting pressurization of said liquid within said container and for pressure dispensing said liquid from within said container, and pressure containment means for receiving and for withstanding pressure forces exerted on said container during dispensing of said liquid from therewithin, said pressure containment means comprising a shroud for receiving said container and for substantially limiting expansion of said container, and a frame for receiving said shroud with said container therein, said container opening comprising a neck projecting out from said container, said frame having means thereon cooperable with said neck of said container for sealably securing said pressurization means to said neck so as to effectively prevent said container from being internally pressurized unless said container is installed within said containment means.

11. A system as set forth in claim 10 wherein said frame includes at least one frame member removably secured to said frame and being movable from an open position in which said shroud together with said disposable container therein may be inserted in and removed from said frame and a closed position in which said at least one frame member is secured to said frame thereby to prevent removal of said shroud from said frame and to at least in part withstand a portion of the pressurization loads exerted on said container.

12. A system as set forth in claim 11 further comprising means cooperable with said frame and with said neck for sealably securing said fitting to said neck only when said disposable container is installed within said frame.

13. A system as set forth in claim 10 wherein said disposable container being insertable into said shroud, the latter having a notch therein for receiving said neck as said disposable container is inserted into said shroud with said neck extending out beyond said shroud.

14. A system as set forth in claim 13 wherein said neck being extendable from a stowed position in which it is at least partially disposed within said outer container thereby to permit stacking of said semi-bulk containers substantially without interference from said necks and an extended position in which it extends out beyond said outer container.

15. A system as set forth in claim 10 further comprising a dispensing line and quick-disconnect means carried by said containment means thereby to permit the ready coupling and uncoupling of said source of pressurized gas to and from said pressurization tube and of said dip tube to and from a dispensing line.

16. A system as set forth in claim 10 wherein said frame includes a plurality of longitudinal members extending generally along the sides of said disposable container and a pair of frame ends, one at each end of the disposable container, for supporting the ends of the container, said longitudinal members being secured to said frame ends.

17. A system as set forth in claim 16 wherein at least one of said longitudinal frame members is releasably secured at one of its ends to one of said frame ends and is pivotally secured at its other end to the other of said frame ends for pivotal movement between an open position in which said disposable container inserted within said shroud to be readily inserted in and removed from said frame and a closed position in which said at least one longitudinal frame member is proximate the side of said shroud and in which both ends thereof are secured to said frame ends thereby to support said shroud against internal pressure within said disposable container.

18. A system as set forth in claim 10 further including a dip tube through which liquid is dispensed from said container, and means carried by said dip tube for generating a signal in response to the level of the liquid in said container dropping below a predetermined level.

19. Apparatus for pressure dispensing a liquid from a disposable container incapable when unsupported of withstanding internal pressure with an adequate margin of safety, said disposable container being made of a liquid impervious material and having at least one opening for communication with the interior of said disposable container, means for receiving said disposable container therewithin and for withstanding substantially all of the internal pressurization forces exerted upon said disposable container, said pressure withstanding means comprising a shroud for withstanding said internal pressurization forces on the sides of said container, and for substantially limiting expansion of said container, and a frame receiving said shroud with said container therein for withstanding the internal pressurization forces on the ends of said container, a fitting sealably cooperable with said at least one opening, said fitting including means for the admittance of pressurized gas of a predetermined pressure into said container thereby to internally pressurize said container and discharge means through which said liquid may be forced from within said container by said internal gas pressure.

20. A method of pressure dispensing a liquid from a semi-bulk, disposable container, the latter having at least one opening for the filling, pressurization, and discharge of a liquid contained within said container, said method comprising the steps of:

filling said container with liquid;

inserting means into said at least one opening for effecting pressurization of said liquid within said container and for the pressure dispensing of the pressurized liquid from within said container;

inserting the container in a pressure containment vessel;

inserting said vessel with said container therein into a frame;

internally pressurizing said container so that said pressure containment vessel withstands substantially all of the pressure forces exerted on the sides of said container to substantially limit expansion of said container and so that said frame withstands substantially all of the axis pressure forces exerted on the container; and dispensing said liquid from within said container via said at least one opening.

21. A system for dispensing of a liquid from a container containing a supply of said liquid therein, said container being of liquid impervious construction and having at least one opening therein, means sealably cooperable with said at least one opening of said container for permitting pressurization of said liquid within said container and for pressure dispensing said liquid from within said container, and pressure containment means for receiving and for withstanding pressure forces exerted on said container during dispensing of said liquid from therewithin, said pressure containment means comprising a shroud for receiving said container and a frame for receiving said shroud with said container therein, said container opening comprising a neck projecting out from said container, said frame having means thereon cooperable with said neck of said container for sealably securing said pressurization means to said neck and for effectively preventing said container from being internally pressurized unless said container is installed within said containment means, said neck sealable securement means comprising a pair of collar members slidably mounted on said containment means and being movable relative to one another between a retracted position in which said collar members are spaced apart thereby to receive said neck therebetween and a closed position in which said collar members surround and engage said neck, said means sealably secured within said opening comprising a stopper, said neck securement means further comprising a cap threadably engageable with said collar members when the latter are closed and engageable with said stopper thereby to force said stopper into sealing engagement with said neck.

22. A disposable container system for pressure dispensing liquid therefrom, said container system comprising an inner, liquid impervious container having at least one inlet/outlet fitting, an outer container enclosing said inner container, a stopper received in said inlet/outlet fitting, said stopper including a port adapted to be connected to a source of pressurized gas thereby to effect pressurization of the interior of said inner container and any liquid therein and a dip tube extending into said inner container through which liquid within said inner container may be pressure dispensed, and means for sealably securing said stopper in place on said inlet/outlet fitting with the free end of said dip tube disposed at a predetermined location within said inner container thereby to permit the pressure dispensing of substantially all of said liquid from within said inner container, said stopper securing means comprising a pair of collars each having an inner bore, said collars being movable from an open position in which said inlet/outlet fitting may be readily inserted within said inner bores of said collars and a closed position in which said collars engage said inlet/outlet fitting thereby to substantially prevent axial movement of said inlet/outlet fitting with respect to said collars, said collars having external threads thereon which mate with one another when said collars are in their closed position, and a screw cap threadably engageable with said threads and engageable with said stopper thereby to force said stopper into sealing engagement with said inlet/outlet fitting as said screw cap is threaded into said collar.

23. In a disposable container assembly for a liquid, said container assembly comprising an inner container of liquid impervious material having an inlet/outlet fitting with a bore therein and an outer container for enclosing said inner container, wherein the improvement comprises: a stopper adapted to be received in said inlet/outlet fitting and means for sealably securing said stopper with respect to said fitting, said stopper securing means comprises a pair of collars each having an inner bore, said collars being movable from an open position in which said inlet/outlet fitting may be readily inserted within said inner bores of said collars and a closed position in which said collars engage said inlet/outlet fitting thereby to substantially prevent axial movement of said inlet/outlet fitting with respect to said collars, said collars having external threads thereon which mate with one another when said collars are in their closed position, and a screw cap threadably engageable with said threads and engageable with said stopper thereby to force said stopper into sealing engagement with said inlet/outlet fitting, as said screw cap is threaded onto said collars.

24. Apparatus for internally pressurizing a disposable container and for pressure dispensing liquid from said container, the latter having an opening, said container upon internal pressurization thereof having outward forces applied thereto in circumferential direction and in axial direction, said apparatus comprising a shroud for receiving said container, for withstanding said circumferential forces exerted on said container, and for substantially limiting expansion of said container, and a frame for receiving said shroud with said container therein, said frame having means at each end thereof and means joining said frame ends for withstanding said axial forces applied to said container.

25. Apparatus as set forth in claim 24 further comprising a stopper assembly having means for permitting internal pressurization of said container and means for dispensing the pressurized liquid from said container, said stopper assembly being cooperable with said frame such that said stopper assembly is sealingly cooperable with said container only when said shroud with said container received therein is received in said frame.

26. Apparatus as set forth in claim 25 wherein said pressurization means comprises an inlet for compressed gas and wherein said liquid dispensing means comprises a dip tube for extending down into the container within the liquid.

27. A method of pressure dispensing liquid from a disposable container which is substantially incapable of withstanding internal pressurization forces required for pressure dispensing with an adequate margin of safety, said method comprising the steps of:

inserting said container in a shroud with the shroud supporting the sides of the container;

inserting said shroud with the container therein into a frame; and internally pressurizing said container so that said shroud withstands substantially all of the pressure forces exerted on the sides of said container to substantially limit expansion of said container and so that said frame withstands substantially all of the axial pressure forces exerted on said container.

28. The method of claim 27 wherein, upon internal pressurization of said container, the pressure forces exerted thereon effectively prevent removal of said shroud with said container therein from said frame.

29. The method of claim 28 wherein said container has an opening, said method further comprising installing a stopper in the opening of said container, said stopper being sealably cooperable with said inlet and being cooperable with said frame only when said shroud with said container therein is received in said frame thereby to prevent pressurization of the container unless the container within said shroud is installed in said frame.

* * * * *